US008176909B2

(12) United States Patent
Ilgner

(10) Patent No.: US 8,176,909 B2
(45) Date of Patent: May 15, 2012

(54) GRINDING TOOL FOR NATURAL STONE FLOORS, ARTIFICIAL STONE FLOORS AND INDUSTRIAL SOILS

(75) Inventor: Thomas Ilgner, Friesenhagen (DE)

(73) Assignee: Ilgner-Schleif-Innovationen GmbH, Friesenhagen (DE)

( * ) Notice: Subject to any disclaimer, the term of this patent is extended or adjusted under 35 U.S.C. 154(b) by 895 days.

(21) Appl. No.: 12/158,703

(22) PCT Filed: Dec. 8, 2006

(86) PCT No.: PCT/IB2006/054684

§ 371 (c)(1),
(2), (4) Date: Jul. 3, 2008

(87) PCT Pub. No.: WO2007/072273

PCT Pub. Date: Jun. 28, 2007

(65) Prior Publication Data

US 2008/0305730 A1 Dec. 11, 2008

(30) Foreign Application Priority Data

Dec. 21, 2005 (CH) ..... 2037/05

(51) Int. Cl.
*B28D 1/20* (2006.01)

(52) U.S. Cl. ..... 125/38; 451/353; 451/359; 451/495; 451/527; 451/533; 451/548

(58) Field of Classification Search ..... 15/180, 15/230; 125/3, 28, 38; 451/495, 526, 527, 451/533, 539, 548, 350, 353, 359
See application file for complete search history.

(56) References Cited

U.S. PATENT DOCUMENTS

| | | | | |
|---|---|---|---|---|
| 3,517,466 | A * | 6/1970 | Bouvier | 451/490 |
| 4,274,232 | A * | 6/1981 | Wylde | 451/490 |
| 4,609,581 | A * | 9/1986 | Ott | 428/100 |
| 5,054,245 | A * | 10/1991 | Coty | 451/353 |
| 5,567,503 | A * | 10/1996 | Sexton et al. | 428/143 |
| 5,586,930 | A * | 12/1996 | Hayashi et al. | 451/548 |
| 6,234,886 | B1 * | 5/2001 | Rivard et al. | 451/353 |
| 6,945,857 | B1 * | 9/2005 | Doan et al. | 451/56 |
| 2002/0127962 | A1 * | 9/2002 | Cho et al. | 451/443 |
| 2005/0172428 | A1 * | 8/2005 | Thysell | 15/4 |

* cited by examiner

*Primary Examiner* — Timothy V Eley
(74) *Attorney, Agent, or Firm* — Laurence A. Greenberg; Werner H. Stemer; Ralph E. Locher

(57) ABSTRACT

A grinding tool for natural stone floors, artificial stone floors and industrial floors allows a greatest possible adaptation to the unevennesses of worn natural and artificial stone floors to be restored by using diamond tools that are flexibly attached. The diamond tools are fixed on a mat so that each individual diamond tool can adapt individually to the grooves and unevennesses of an animated natural stone and stone floor. The grinding pattern of a surface machined with said grinding tool corresponds to a newly produced natural stone or artificial stone floor.

10 Claims, 5 Drawing Sheets

GRINDING TOOL FOR NATURAL STONE FLOORS, ARTIFICIAL STONE FLOORS AND INDUSTRIAL SOILS

BACKGROUND OF THE INVENTION

Field of the Invention

The present invention concerns a grinding tool for natural stone, artificial stone, and industrial floors. The grinding tool has a power-driven machine with at least one driven shaft journal, and a robust haseplate connected to each.

Floor slabs made of natural stone (marble, granite, basalt, etc.), artificial stone (terazzo on a cement, PU, or epoxy base), and industrial floors (concrete, cast asphalt, polished composition floors, etc.), without surface glazing were previously described before delivery. In particular, we often grind on natural stone again in its laid-down condition. The opinion is held that such a grinding of the floor produces a good appearance just on the "last grinding". After a certain length of time, the gaps and pores in such stone floors fill up with dirt, which naturally can be removed to a certain degree by cleaning. After some length of time, dirt remaining in gaps and pores accumulates, which is no longer removed by normal cleaning. Then one has the choice of replacing the whole floor with new slabs or grinding the existing slabs in place so that these dirt remnants together with a certain amount of the material of the floor slabs is removed by grinding.

Basically, natural, laid stone floors are naturally viewed as flat surfaces, although the tile layer in his work lays the slabs differently with nuances of height. Every natural stone acquires not as the least a better structure and acts more lively if the slabs exhibit different heights themselves and also with respect to one another. In common with this, stumbling points are not constructed as height differences and they are dangerous, since unevennesses in the range of 0.5-1 mm which lend structure and liveliness to the floor.

Grinding machines known from prior art for cleaning and renovating natural and artificial stone floors are as a rule equipped with diamond tools, which are fastened to fixed disks. Natural and artificial stone floors exhibit the dips and unevennesses described above. Diamond tools fixed to a level and rotating disk do not grip onto deeper lying positions and dissimilar heights, and the whole plane is ground down to a monotonous virtually flat surface. But for the visual liveliness of the appearance which a natural or artificial stone tile offers, this is not desirable.

Conventional systems are fixed. In US patent publication No. 2005/0172428, a tool is provided which makes a cellulose rubber fast to the disk of a power-driven machine, which is connected to a robust plate which for its part carries the holder with diamonds. The robust plate is thereby kept flexible. The diamond tool mounted firmly on this fixed disk always moves however in the given plane of this fixed plate. But such a tool that helps the diamonds adjust the differently bent natural or artificial stone tiles does not help for dips and unevennesses in individual slabs or for cleaning gaps, in particular it does not help at all where gaps cross.

BRIEF SUMMARY OF THE INVENTION

The present invention aims not only to improve a grinding tool for natural stone, artificial stone, and industrial floors of prior art that has retained the advantage of known grinding tools but that the equipment can grind and work on dips and gaps in slab floors.

This objective is resolved with a grinding tool for natural stone, artificial stone, and industrial floors with the characteristics of patent claim 1. Further characteristics according to the invention are given in the related claims and the advantages of which are clarified in the following description.

The figures represent preferred exemplary embodiments, which are clarified in the following description.

DESCRIPTION OF THE INVENTION

Figure 1:
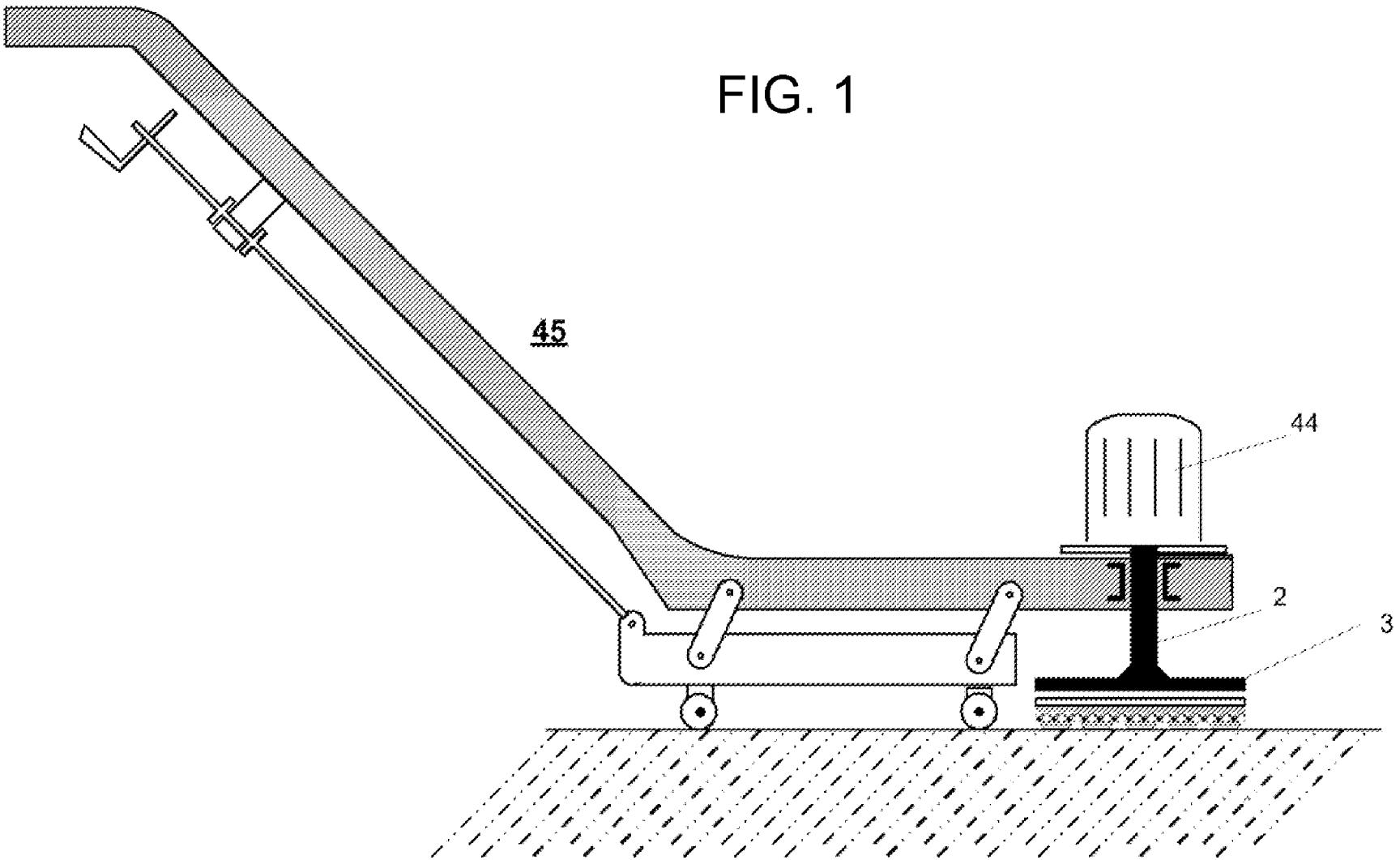
FIG. 1 a grinding tool with a power-driven machine and drive

FIG. 1 depicts a power-driven machine such as, for example, is used for grinding natural and artificial stone floors. For large surfaces, self-operating power-driven machines 45 are used which are operated by an operator sitting on top. Power-driven machines 45 are not further introduced here, because they use the function of the invention objective that coincides with all of the models offered on the market. A drive 44, for example, operates an electric motor or combustion engine with one or several shaft journals 2. This shaft journal 2 is connected to a baseplate 3. The baseplate 3 is set in rotation by the shaft journal 2 in the middle of the drive 44.

Figure 2:
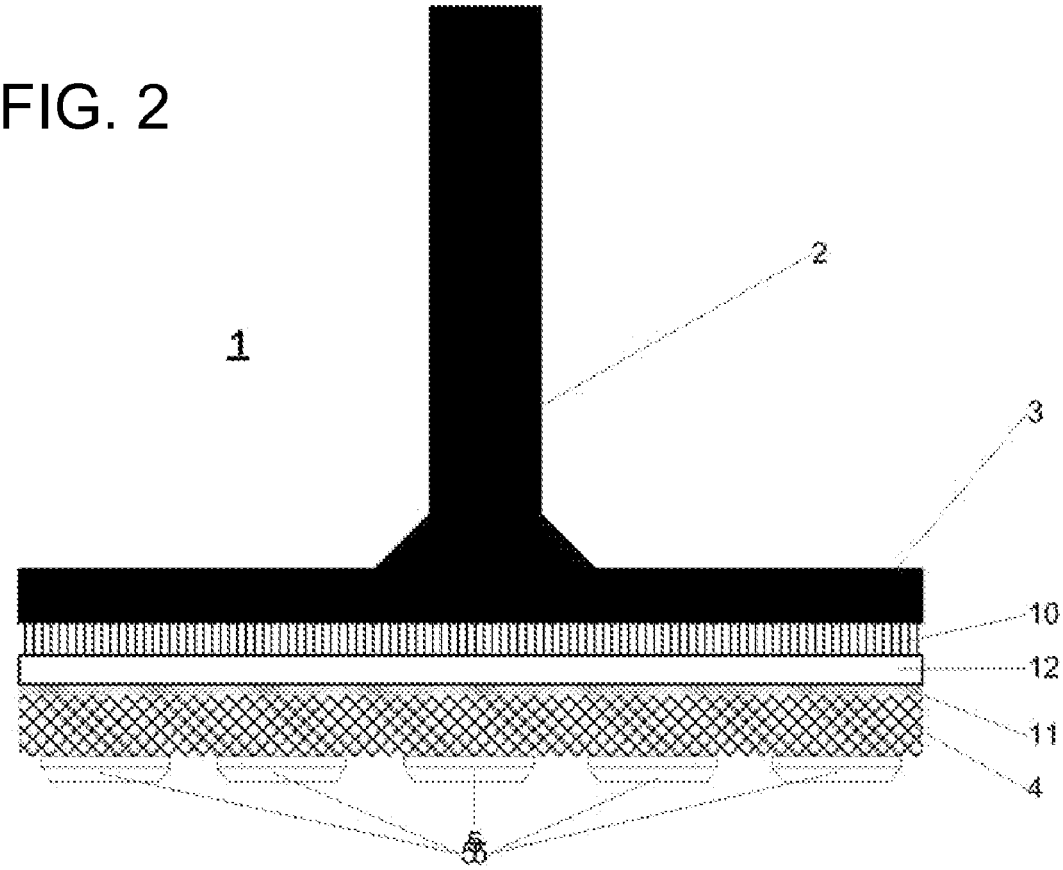
FIG. 2 section through a grinding tool
Figure 11:
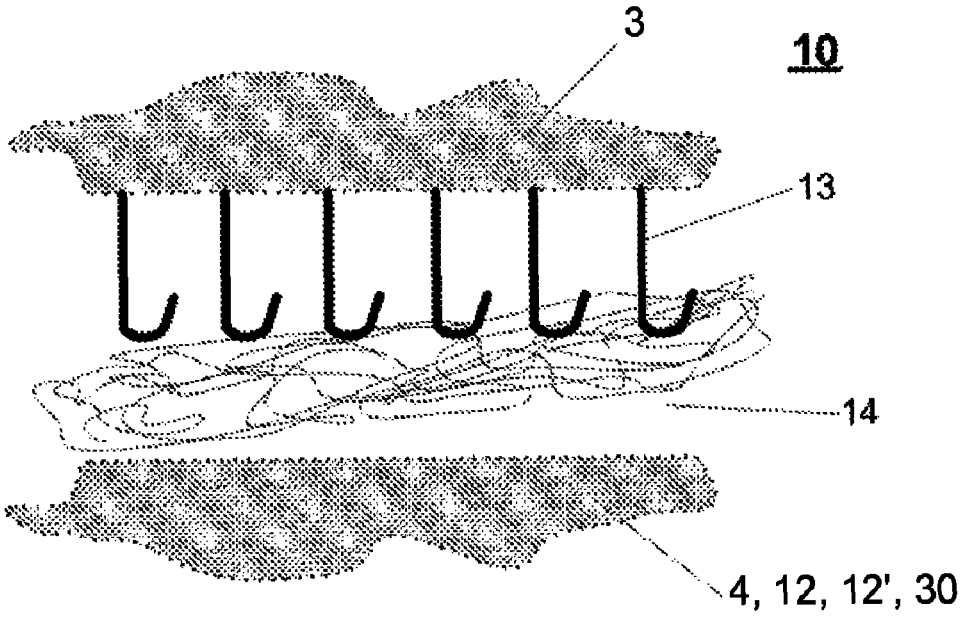
FIG. 11 section through the connection element

On this baseplate 3 is fastened a detachable connector element 10 (FIG. 2. Preferably it is for example a Velcro fastening (FIG. 11). But a detachable glued connection can also be used, such as are used for fastening furs onto skis. In the case of the use of a Velcro fastening, the side with the base 13 for example is fastened onto the baseplate 3, while for fastening a mat 4 (FIG. 11) an appropriate Velcro 14 is provided for this, for example a felt. The use of a detachable connector element 10 offers the great advantage for mats 4 and diamond tool 5 to be rapidly and simply changed out. This is an unalterable improvement, because for renovating with the grinding inserts that were described, large surfaces have to be able to be worked on in a short time. Rapid tool replacement is of decisive significance for the economical use of such grinding machines. This also holds true both for the rapid replacement of mats 4 used and diamond tools 5 and for simply using a whole other grain size of diamond tool 5. A mat 4 detachably connects directly through the connector element 10 or by a support 12 (FIG. 2) to the baseplate 3. The mat 4 is for example an elastic polyester and is called by the tradename of "Polyester Pad". The Velcro of the connector element 10 is firmly fastened to the mat 4.

The diamond tool 5 is glued onto the mat 4 with a special adhesive material. The entire unit consisting of support 12, membrane 11, mat 10, and diamond tool 5 can be rapidly connected by means of the detachable connector element 10 to the baseplate 3. If the support 12 and the membrane 11 are omitted, the mat 4 is constructed with the Velcro 14 and the glued diamond tool 5 as a unit, which is detachably fastened by the connector element 10 onto the baseplate 3. This arrangement is entirely sufficient for simple application and tools.

In the type described above, fitted-out grinding tools 1 offer the advantage that the diamond tool 5 can be replaced very rapidly. Even if this is important for the grinding process, different grain sizes of diamond tool 5 are still used at the beginning and the end finish of a surface area. Independent of grain size and characteristics of the diamond tool 5, the construction of the tool with baseplate 3, connector element 10, and mat 4 on the diamond tool 5 offers the possibility that each diamond tool 5 is automatically adjusted for the respective situation for concavities, gaps, and slightly uneven surfaces.

Figure 3:
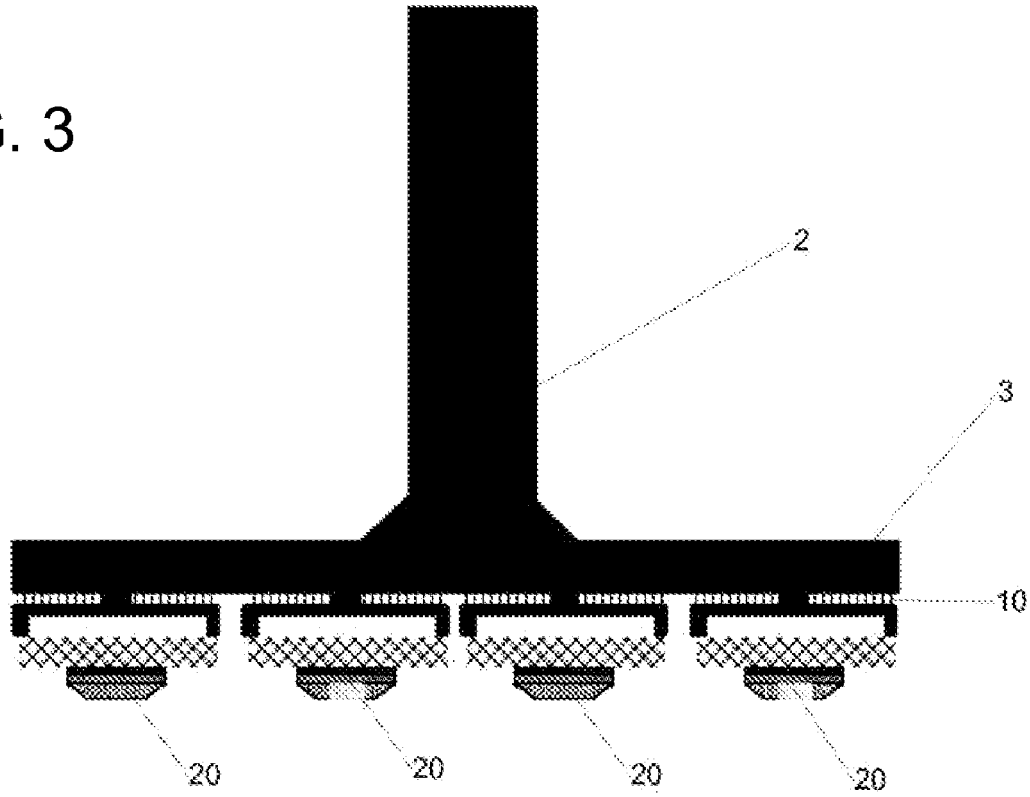
FIG. 3 section through a grinding tool with grinding insert

It is seen from FIG. 2 how a support 12 is used, so the Velcro 14 of the connector element 10 is firmly fastened to the support 12. The support 12 for example is made of a quick-set synthetic or hard rubber. In using quick-set synthetic for the support 12, an optimal result is attained, if a membrane 11 made of cellulose rubber is still used between support 12 and mat 4. The membrane 11 constructed with the support 12, the Velcro 14, and the mat 4 is a firmly connected unit (FIG. 2). In order to offer high flexibility for the insert of the diamond tool 5, several such units are used on a baseplate 3. In FIG. 3 it is for that reason shown how a baseplate 3 with several such units, called a grinding insert 20, can be fitted out. This grinding insert (FIGS. 4 to 7) consist of a connector element 10', support 12', membrane 11', mat 4', and a diamond tool 5, 5'.

In the baseplate 3 spare parts for example are provided, in which the cam 21 of the grinding insert 20 (FIGS. 4 to 7) is received. The grinding inserts 20 can thus clearly be positioned on the baseplate and can be individually changed out. In this way grinding inserts 20 can also used with diamond tools 5 of a different grain sizes or grinding inserts 20 with a harder mat 4. Particularly on highly damaged natural stone floors, it is recommended to work with diamond tools, which are fastened to a firm or at least hard elastic underlayer.

For highly damaged floors, the use of a soft mat is proven to be a disadvantage. The diamond tool 5 follows each unevenness in the floor, but with actually large height differences, it no longer grinds all of the area. In this case a harder underlayer is used for the diamond tool 5 and this is fastened for example to the membrane 11 or even directly to the baseplate 3. The flexibility of the grinding tool introduced makes this possible.

Figure 6:
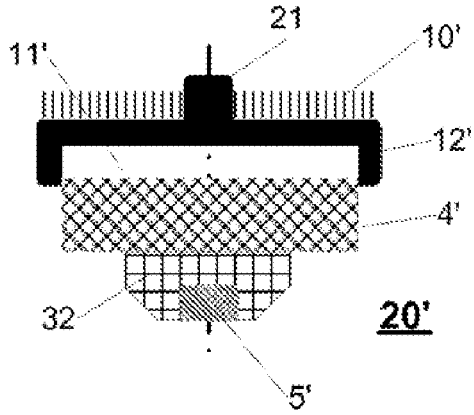
FIG. 6 section through a grinding insert
Figure 5:
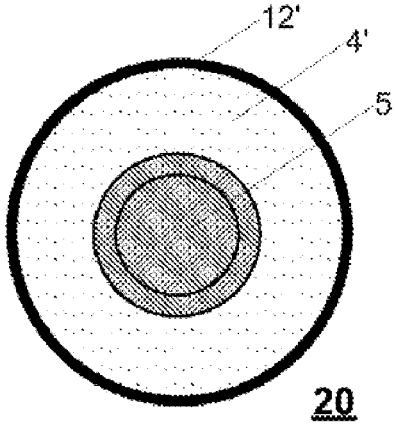
FIG. 5 view of a grinding insert
Figure 7:
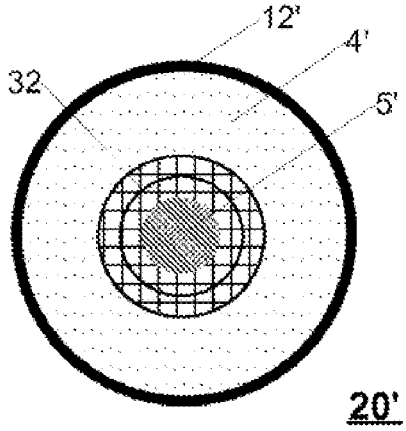
FIG. 7 view of a grinding insert

Around a particularly brittle diamond tool 5 to protect against breaking off the corners, the diamond tool as shown in FIGS. 6 and 7 can be provided with a synthetic upper part 32.

Figure 8:
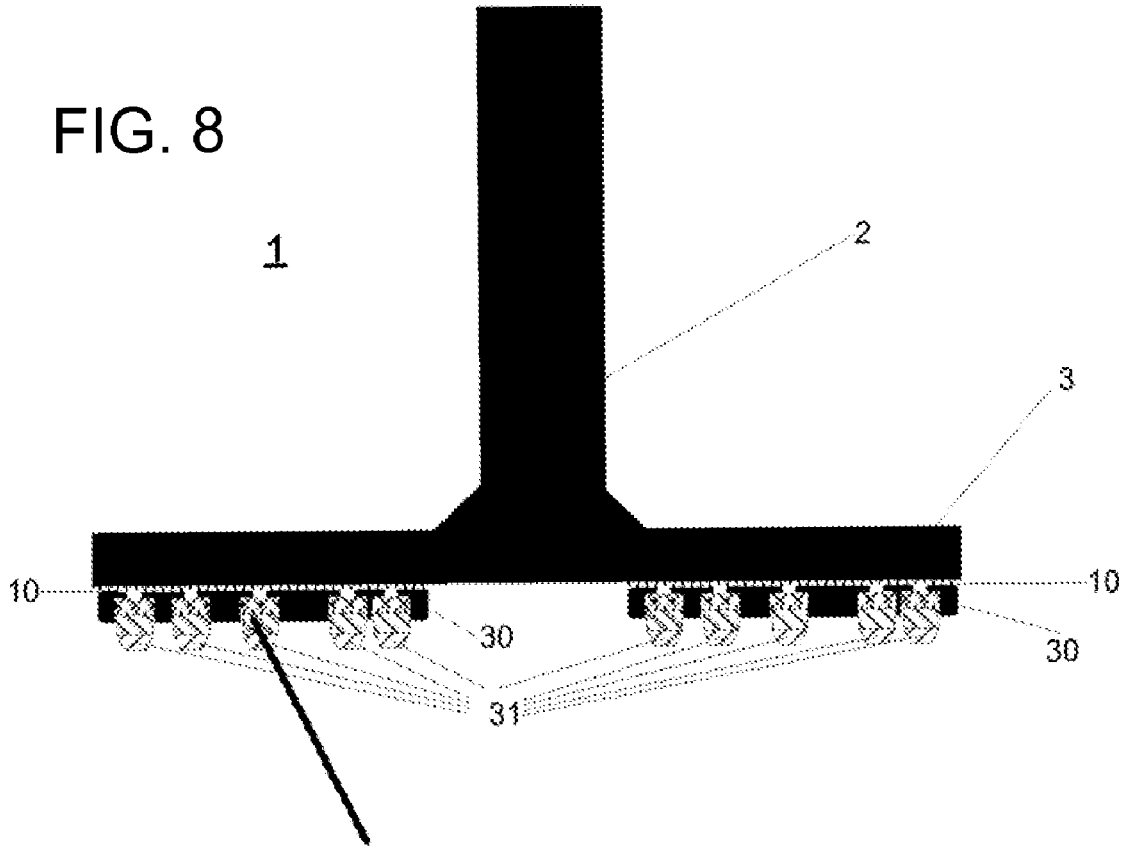
FIG. 8 section through a grinding tool with a multiple support and insert
Figure 9:
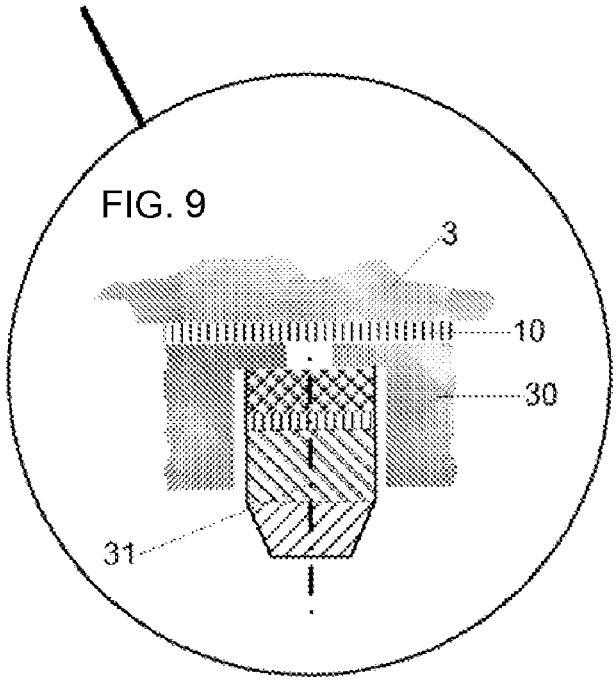
FIG. 9 section through an insert in the multiple support

Since several grinding inserts can be used on one baseplate 3, the idea arises of using several supports 30 on one baseplate 3 (FIG. 8), but this support 30 can be constructed as a multiple support 30 which can accommodate several fingers (FIG. 9). There are several fingers 31 in a multiple support 30. This multiple support 30 is detachably fastened by means of a connector element 10 to the baseplate 3. The advantage of such an arrangement is that first of all individual fingers 31 can be individually changed out in case of an accident and secondly a mixture of fingers 31 with different diamond tools 5 can be used in a multiple support 30.

Figure 10:
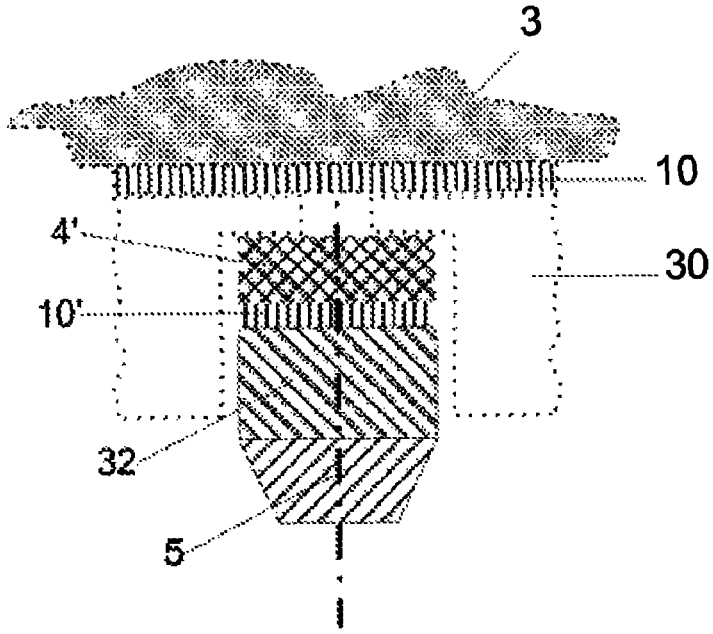
FIG. 10 section through a insert

The construction of this device differs very slightly from that stated above, however the basic principle is always the same, since the diamond tool 5 is glued directly or indirectly to a flexible and elastic underlayer in this presentation on a mat 4. The multiple support 30 exhibits in the openings provided for the receipt of the fingers 31 as shown in FIG. 10 a mat 4' and a connector element 10'. To this connector element 10' are detachably fastened the fingers 31 with the multiple support 30. The opening in the multiple support 30 is chosen to be large enough that the fingers 31 can move on the mat 10' in a known area.

Figure 4:
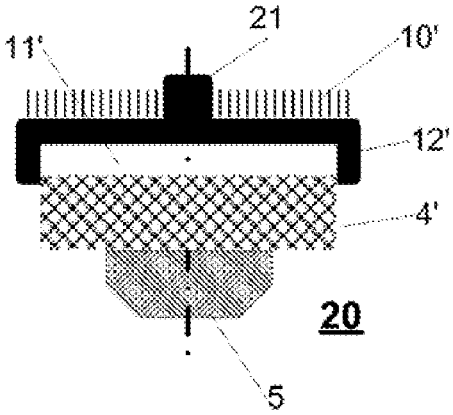
FIG. 4 section through a grinding insert

The fingers 31 are provided with a synthetic upper part 32. The upper part can surround the diamond tool 5 as shown in FIG. 6 or the diamond tool can be connected with a synthetic upper part as shown in FIGS. 4 and 10. Certain diamond tools 32 must be especially hard and are brittle for that reason. Because the fingers 31 exhibit a certain height and the synthetic upper part 32 is easy to paint, the user can rapidly recognize by means of this method from the corresponding color which grain size of diamond tool 5 is being used. This facilitates the rapid replacement of the diamond tool 5.

The connector element 10, 10' can be a Velcro fastening as previously mentioned (FIG. 11). The base 13 is normally fastened to the baseplate 3 and the textile Velcro 14 is attached to the mat 4, to the support 12, 12', or to the multiple support 30. The synthetic upper part 32 is provided with fingers 31 with the Velcro and the base 13 is attached to the mat 4' which is connected to the multiple support 30. This arrangement however is not important. Certain uses may inversely favor the arrangement.

A much greater advantage of the tool of this sort being manufactured and used is the possibility of their insertion. While conventional tools can normally be used only for so-called "wet grinding", the tool presented here is used even for so-called "dry grinding". With the appropriate suction devices, dry grinding offers the possibility of different grinding appearances, which is a very great advantage for the beauty of a stone floor.

The invention claimed is:

1. A grinding tool for grinding natural stone floors, artificial stone floors, and industrial floors, comprising:

a power-driven machine with at least one driven shaft journal;

a robust baseplate connected to said at least one driven shaft journal;

a soft, flexible, and elastic mat having a first side and a second side opposite said first side;

at least one diamond tool fastened to said first side of said mat; and a connector element configured for forming detachable connections and detachably connecting said second side of said mat, opposite said diamond tool, to said baseplate; and a hard elastic membrane fastened to said second side of said mat opposite said diamond tool, and a support firmly connected to said hard elastic membrane, and said support being detachably connected by said connector element to said baseplate.

2. The grinding tool according to claim 1, wherein said diamond tool with said mat, said membrane, and said support are firmly connected to form a grinding insert, and wherein said connector element detachably connects said grinding insert to said baseplate via said support.

3. The grinding tool according to claim 2, wherein said grinding insert includes a cam, and said baseplate is formed with means for defining a fixed position of said support on said baseplate by receiving said cam.

4. The grinding tool according to claim 2, wherein said grinding insert is one of a plurality of grinding inserts mounted to said baseplate.

5. The grinding tool according to claim 4, wherein each said grinding insert includes a cam, and said baseplate is formed with means for defining a fixed position of each said support on said baseplate by receiving said cam.

6. The grinding tool according to claim 1, which comprises a multiple support detachably connected to said baseplate by way of said connector element, said multiple support having at least one finger consisting of a connector element, a synthetic upper part, and a diamond tool, and wherein a mat is laid out between said multiple support and said connector element, and said mat and said multiple support are connected to one another.

7. The grinding tool according to claim 1, wherein said soft, elastic mat is a multiply usable mat manufactured of polyester.

8. A grinding tool for grinding natural stone floors, artificial stone floors, and industrial floors, comprising:

a power-driven machine with at least one driven shaft journal;

a robust baseplate connected to said at least one driven shaft journal;

an elastic flexible mat carrying a plurality of mutually spaced-apart diamond tools, said diamond tools being rigidly connected to said mat;

said mat having a connector element being configured for detachable connection to said baseplate, said mat being soft to such a degree as to enable independent tilting and/or movement of individual ones of said diamond tools relative to a surface of said mat adjoining the respective said diamond tool; and a hard elastic membrane fastened to a side of said mat opposite said diamond tools, and a support firmly connected to said hard elastic membrane, and said support being detachably connected by said connector element to said baseplate.

9. The grinding tool according to claim 8, wherein said diamond tools are connected to said mat by way of adhesive material.

10. The grinding tool according to claim 8, which comprises a plurality of hooks on said baseplate for holding said mat on said baseplate with a hook-and-loop connection.

* * * * *